United States Patent [19]

Sahli

[11] 4,099,469

[45] Jul. 11, 1978

[54] DRAFTING TABLE

[75] Inventor: Fritz Sahli, Thun, Switzerland

[73] Assignee: Albert Fritschi, Berne, Switzerland

[21] Appl. No.: 790,126

[22] Filed: Apr. 22, 1977

[30] Foreign Application Priority Data

Apr. 29, 1976 [CH] Switzerland ..... 5419/76

[51] Int. Cl.[2] ..... A47F 5/12; A47B 27/00

[52] U.S. Cl. ..... 108/1; 108/115; 312/231

[58] Field of Search ..... 108/115, 116, 128, 1, 108/6, 4; 312/140.2, 231; 248/441, 460, 463, 464

[56] References Cited

U.S. PATENT DOCUMENTS

| | | | |
|---|---|---|---|
| 571,980 | 11/1896 | Penfield | 108/4 |
| 874,052 | 12/1907 | Cantrell | 108/4 |
| 912,589 | 2/1909 | Mashek | 108/1 |
| 1,480,631 | 1/1924 | Osborn | 312/231 |
| 2,244,773 | 6/1941 | Hawk | 248/464 X |
| 2,638,397 | 5/1953 | Wykoff | 312/231 |
| 2,764,462 | 9/1956 | McDonald | 312/140.2 |
| 3,031,247 | 4/1962 | Schieve | 312/231 |
| 3,124,085 | 3/1964 | O-Shantez | 108/115 |
| 3,141,260 | 7/1964 | Donipier | 248/464 X |
| 3,365,258 | 1/1968 | Downing | 312/140.2 |
| 3,476,456 | 11/1969 | Canavan | 312/231 |
| 3,745,935 | 7/1973 | Douglas | 108/1 |

*Primary Examiner*—James T. McCall

*Attorney, Agent, or Firm*—Townsend and Townsend

[57] ABSTRACT

A drafting table which can be folded together by simple manipulation so as to occupy very little space during packing, transportation, or storage. The table comprises two outriggers, two supporting columns, and a table plate. The supporting columns are each composed of two telescoped bars, and the outriggers are respectively pivotable about the inner of these bars.

6 Claims, 3 Drawing Figures

DRAFTING TABLE

This invention relates to a drafting table of the type wherein a table plate is borne by a stand having two vertical supporting columns, each including an outer bar and an inner bar telescoped therein, and having an outrigger associated with each of the columns for determining the base plane of the table.

The known drafting tables generally consist of a rigid stand and a movable table plate. The disadvantage of such tables is that they take up a great deal of space during transportation. This means that they require excess expenditure for packing material and incur increased transportation costs.

It is an object of this invention to provide a drafting table which, by simple manipulation, can be folded together in such a way that it takes up a minimum of space for packing and transportation.

A further object of this invention is to provide a drafting table which also lends itself for use in smaller workplaces were it can quickly be put into a space-saving form and set aside when not in use.

To this end, in the drafting table according to the present invention, each outrigger is pivotable about the inner bar of the supporting column with which it is associated.

A preferred embodiment of the invention will now be described in detail with reference to the accompanying drawings, in which.

Figure 1:
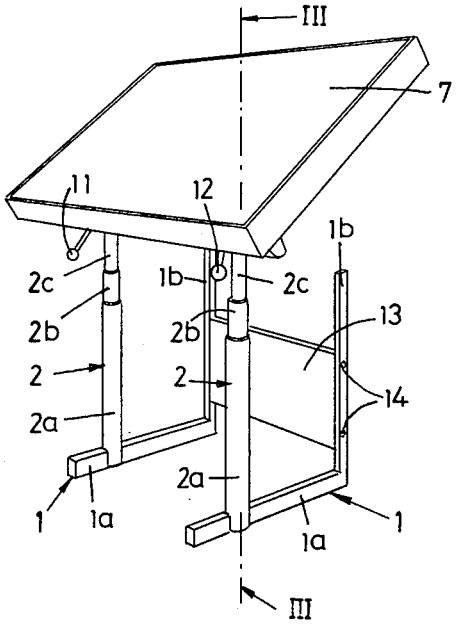
FIG. 1 is a perspective view of the drafting table set up for use.
Figure 2:
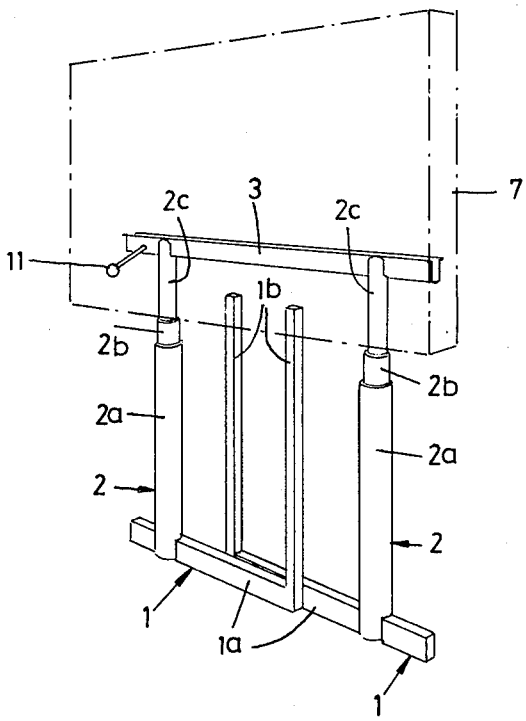
FIG. 2 is a perspective view of the drafting table when folded.
Figure 3:
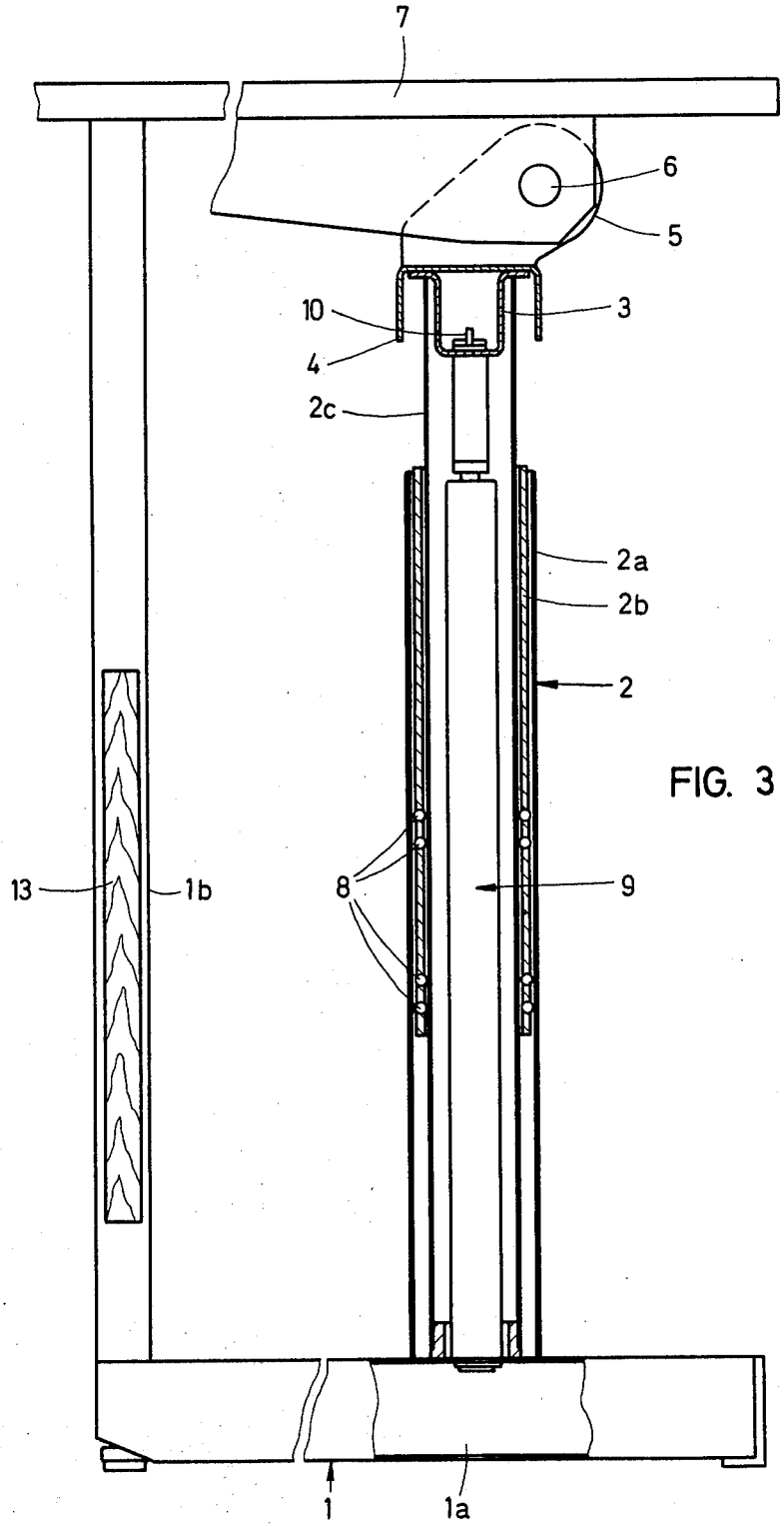
FIG. 3 is a vertical section taken on the line III—III of FIG. 1 through a supporting column of the drafting table.

The drafting table illustrated in FIGS. 1 and 2 is made up essentially of two outriggers 1, two supporting columns 2, and a table plate 7. Outriggers 1 each comprise a horizontal leg 1*a* and a vertical leg 1*b*. Vertical supporting columns 2 are respectively rigidly secured to legs 1*a* of outriggers 1, e.g., by welding. Each supporting column 2 comprises an outer telescoping bar 2*a*, a ball-bearing bushing 2*b* with balls 8 (FIG. 3), and an inner telescoping bar 2*c*. Within each column 2 is a gas pressure spring 9 which exerts vertical pressure upon inner telescoping bar 2*c*. Ball-bearing bushing 2*b* is biased so that columns 2 can be manufactured without fitting work, and so that inner telescoping bar 2*c* is slidable without play with respect to outer telescoping bar 2*a*. The design of supporting columns 2 as described above enables both vertical adjustment of table plate 7 and lateral pivoting of outriggers 1 together with outer bars 2*a* with respect to inner bars 2*c*. A connecting crosspiece 3 is secured to the tops of inner bars 2*c*. Disposed over crosspiece 3 is a rail section 4 having lugs 5 through which a swivel rod 6 passes. The position of table plate 7 can be varied about swivel rod 6 with the aid of an adjustment lever 12. By means of a control handle 11, a valve 10 can be operated in order to adjust inner bars 2*c*, and hence table plate 7, vertically with respect to outer bars 2*a*. A bracing plate 13, secured by means of screws 14 to vertical legs 1*b* of outriggers 1, ensures improved stability of the drafting table.

If the drafting table is to serve as a desk, table plate 7 may be supported in a horizontal position upon the top end faces of vertical legs 1*b*. If the stability of the drawing table is to be still further increased, braces may also be disposed between horizontal legs 1*a* of outriggers 1, for example.

In order to convert the drafting table from the position for use shown in FIG. 1 to the transportation or storage position shown in FIG. 2, it suffices to remove bracing plate 13, pivot outer bars 2*a* together with horizontal legs 1*a* laterally through about 90°, and fold table plate 7 into a vertical position. If the drafting table is to take up even less space in shipping position, table plate 7 can be taken off entirely.

A significant advantage of the drafting table according to the present invention is that the table plate can easily be adjusted in height and fixed in the desired position by means of a simple manipulation. Furthermore, the drafting table can be converted from its position of use into its transport position very quickly and without any special tools being required for that purpose.

What is claimed is:

1. An adjustable drafting table adapted to be stored in a collapsed, essentially planar configuration, comprising: first and second, generally U-shaped table supports, each support including a generally horizontally disposed base member and a pair of spaced apart, upwardly protruding first and second support posts; transverse means rigidly interconnecting upper ends of the first posts in relative, spaced apart positions; means securing a table plate to the supports for pivotal movement of the plate relative to the supports about a horizontal axis between a first, substantially vertical position and a second position that is inclined from the vertical; and adjustment means disposed within the first posts, connecting the upper ends of the first posts with corresponding lower ends of the first posts, and permitting relative vertical and relative pivotal movements about vertical axes between the upper ends and the lower ends of the first posts so that the U-shaped supports can be positioned in opposing and spaced apart relation to each other for supporting a portion of the table plate on the second posts while the U-shaped supports can be pivoted to substantially align the second posts with the first posts and the table plate can be pivoted into the vertical position for storage of the drafting table in a space saving configuration.

2. A drafting table according to claim 1 wherein the adjustment means comprises inner and outer tubular members, each such member defining one of the ends of the first posts, and ball bearing means disposed between the members permitting relative axial and rotational movements between the members.

3. A drafting table according to claim 2 including spring means disposed within the inner tubular members and biasing the transverse means away from the base members.

4. A drafting table according to claim 3 including means for activating the spring means to vary the distance between the transverse means and the base members.

5. A drafting table acccording to claim 1 including a spreader bar disposed between the second posts when the U-shaped supports are in their spaced apart, opposing positions, and means for removably securing the spreader bar to the second posts to maintain the latter in their spaced apart positions and to thereby regidify the drafting table.

6. An adjustable drafting table which is collapsible into an essentially planar configuration to facilitate the storage and shipment of the table while retaining the functional connections between components of the table, the table comprising: a table plate, a transverse rail, and pivot means connecting the plate and the rail and permitting relative pivotal movements between the two about a substantially horizontal axis that is parallel to the plate and to the rail; first and second, telescoping, spaced apart, upright support posts secured to the rail, each post including telescopingly engaged inner and outer tubular members, bearing means disposed between the members and permitting relative rotational and axial movements between the members, spring means disposed within the members, operatively connected with an end of each member, and exerting a force axially biasing the members apart; outrigger means for each post, the outrigger means including a base member and an upright member defining a plate support surface; means connecting one of the tubular members of each post to the rail and the other one of the tubular members to the base member so that the outrigger means is pivotable relative to the rail about a vertical axis; means for adjusting the overall axial length of the tubular members so as to correspondingly adjust the distance between the plate and the base member; and bracing means demountably attached to the upright members for maintaining the upright members in their spaced apart relationship when the drafting table is in use; whereby the drafting table can be used by pivoting the outrigger means about the vertical axes of the posts to place the upright members in the spaced apart positions and the plate can be pivoted about said horizontal axis into an inclined position until the plate contacts the plate supporting surface of the upright members while the bracing means rigidifies the upright members and, therewith the drafting table in its usable position, and whereby further, the drafting table can be collapsed into its shipping and storage configuration by removing the bracing means, pivoting the outrigger means about said vertical axes until the outrigger means are in substantial alignment with each other and with the posts, and pivoting the plate about said horizontal axis until it too is in substantial, vertical alignment with the posts and the outrigger means.

* * * * *